United States Patent [19]

Ooms

[11] 3,956,660

[45] May 11, 1976

[54] ELECTRIC INCANDESCENT LAMP

[75] Inventor: Leo Frans Maria Ooms, Eindhoven, Netherlands

[73] Assignee: U.S. Philips Corporation, New York, N.Y.

[22] Filed: Dec. 12, 1974

[21] Appl. No.: 532,310

[30] Foreign Application Priority Data

Jan. 21, 1974 Netherlands ..... 7400762

[52] U.S. Cl. ..... 313/222; 174/50.64; 313/315; 313/332

[51] Int. Cl.[2] ..... H01K 1/36

[58] Field of Search ..... 313/222, 332, 315, 318; 174/50.64, 50.61, 17.05

[56] References Cited

UNITED STATES PATENTS

| | | | |
|---|---|---|---|
| 3,264,516 | 8/1966 | Paschedag | 313/332 X |
| 3,588,315 | 6/1971 | Levand et al. | 313/317 |

*Primary Examiner*—Robert J. Corcoran
*Assistant Examiner*—Darwin R. Hostetter
*Attorney, Agent, or Firm*—Frank R. Trifari

[57] ABSTRACT

A halogen incandescent lamp comprises a lamp envelope which is sealed by one or two pinch seals in which one or more foils and conductors welded thereto are sealed and in which pinch seals means are present which form a cavity adjoining the points of the weld of the foil to a conductor.

3 Claims, 5 Drawing Figures

ELECTRIC INCANDESCENT LAMP

Figure 1:
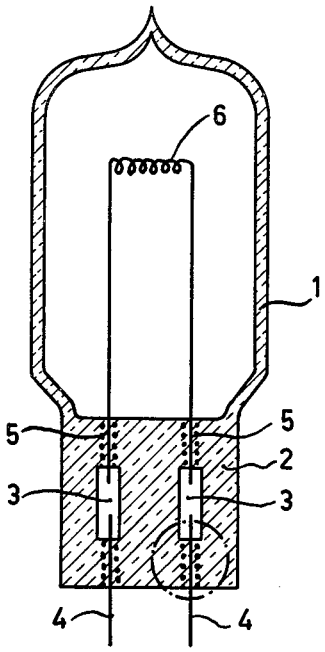

The invention relates to an electric incandescent lamp, in particular a halogen incandescent lamp, which comprises a lamp envelope of a transparent material, preferably quartz glass, in which a filament is stretched, which lamp envelope is sealed by at least one pinch seal in which at least one thin foil is sealed with preferably consists of molybdenum, which foil is welded to two or more conductors which extend to outside the pinch seal. Such an incandescent lamp is known inter alia from the published Dutch Pat. Application No. 7,100,602.

A detrimental phenomenon occurring in electric incandescent lamps of this type is the explosion of the lamp envelope at the end of the life of the lamp. The explosion of the lamp envelope may be explained as follows.

The end of the life of the lamp is usually caused in that the filament fuses. In many cases an arc will be formed so that a very large current starts flowing. Investigations have proved that as a result of said large current the molybdenum starts melting and expanding in those places where the current concentration is largest. The current concentration is largest in the welded points, that is to say the points where the conductors are welded to the foil. As a result of the expansion of the foil material, the pinch seal may burst so that the lamp envelope is weakened to such an extent that it explodes.

It is the object of the invention to provide a solution to said phenomenon.

For that purpose, the electric incandescent lamp of the above-mentioned type is characterized according to the invention in that the pinch seal comprises means which form a cavity which adjoins the point of the weld of the foil to at least one of the conductors. Such a cavity forms an escape possibility for the foil material expanding upon melting.

For the rest it is known from the above-mentioned patent application that upon sealing the foil and the conductors in the quartz glass, an open communication can remain between on the one hand the interior of the lamp envelope and the edge of the foil facing said interior and on the other hand the other edge of the foil and the outside of the lamp. Said open communications are formed by capillaries which extend along the conductors and may be formed in the formation of the pinch seal in that the quartz glass does not flow against the full circumference of the conductors. In the series production of said lamps, however, it is not ensured that each lamp has a sufficiently large cavity; in many cases the capillary will be too small or will even be absent. According to the invention, however, the pinch seal has means which ensure that a cavity is present which is sufficiently large to offer space to the melting foil material.

From the above it will furthermore be obvious that filling the capillaries with, for example, a glass containing lead borate or antimony borate, as is known from the said Dutch Patent Application, removes a possibly present escape possibility for the melting molybdenum and hence increases the possibility of explosion of the lamp envelope at the end of the life of the lamp.

A favourable embodiment of the electric incandescent lamp according to the invention is characterized in that the means are formed by a sheath-like member which surrounds the conductor and the inner diameter of which is at least 100 to 200 microns larger than the diameter of the conductor. The sheath-like member is preferably formed by a helically wound piece of wire which surrounds the conductor with a certain amount of play. Experiments have proved that when a sheath-like member is used the inner diameter of which is at least 100 to 200 microns larger than the diameter of the conductor, a cavity is formed which is sufficiently large to prevent explosion of the lamp envelope. According to another advantageous embodiment the sheath-like member is formed by a tube of quartz glass which surrounds the conductor with a certain amount of play.

Another favourable embodiment of the electric incandescent lamp according to the invention is characterized in that the means are formed by at least one groove occurring in the surface of the conductor and extending in the longitudinal direction of the conductor. During the manufacture of the pinch seal said groove should be oriented so that the quartz glass does not flow into the groove. The groove should be oriented towards one of the sides of the pinch seal.

Figure 2:
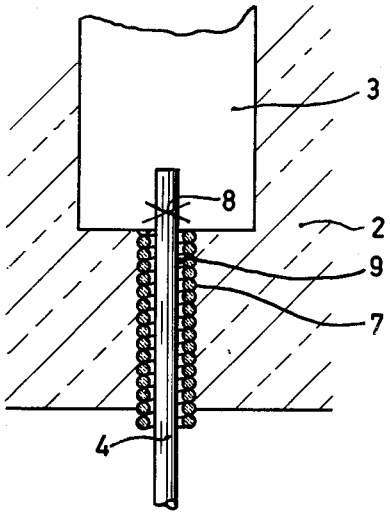
Figure 3:
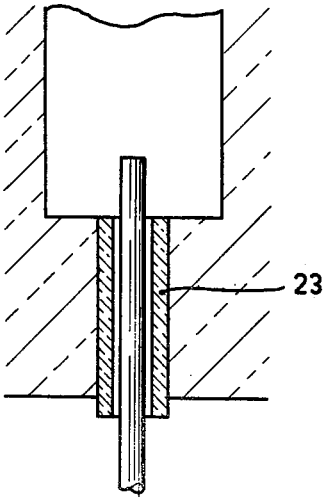
Figure 4:
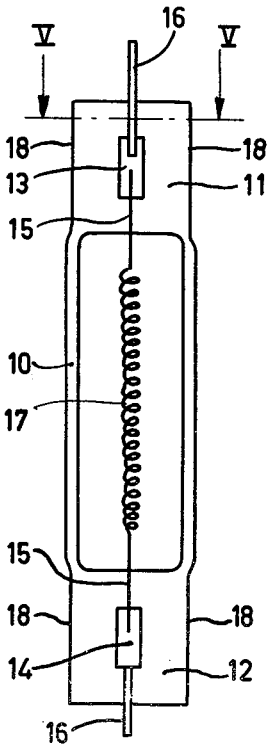
Figure 5:
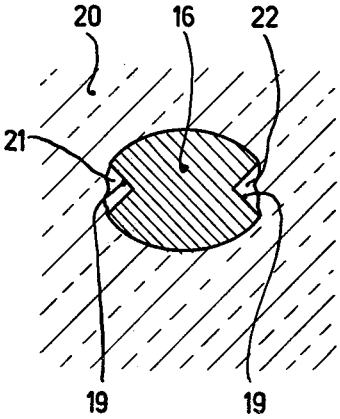

The invention will be described in greater detail with reference to the drawing, in which FIG. 1 shows an embodiment of an electric incandescent lamp according to the invention, FIG. 2 shows the encircled detail of FIG. 1 on an enlarged scale, FIG. 3 shows a detail of another incandescent lamp according to the invention, FIG. 4 shows still another incandescent lamp according to the invention, and FIG. 5 is a cross-sectional view taken on the line V—V of FIG. 4 on an enlarged scale.

In FIG. 1, the lamp envelope of the electric incandescent lamp according to the invention is designated as 1. On one side the lamp envelope is sealed by a pinch seal 2 in which two thin foils 3 of molybdenum are sealed. Current conductors 4 and 5 are welded to the foils 3. A filament 6 is stretched between the current conductors 5 in the lamp envelope. The conductors 4 and 5 are each surrounded by a helically wound piece of wire 7 in the form of a sheath-like member which adjoins the point of weld 8 (see FIG. 2) where the conductor is welded to the foil. By said piece of wire 7 a cavity 9 adjoining the point of weld is formed into which the melting foil material can flow at the end of the life of the lamp. The inner diameter of the wire winding 7 in this embodiment is 200 microns larger than the diameter of the conductor.

In the detail of the incandescent lamp shown in FIG. 3 a quartz glass tube 23 is used instead of a helically wound piece of wire, which tube is sealed during the pinching operation and forms a cavity adjoining the point of the weld.

The embodiment shown in FIG. 4 of the electric incandescent lamp according to the invention shows a tubular lamp envelope 10 which at its ends is sealed by pinch seals 11 and 12. Thin foils 13 and 14 with the conductors 15 and 16 welded thereto are sealed in said pinch seals. A helically wound filament 17 is stretched between the conductors 15 and extends coaxially in the lamp envelope. The conductors 15 and 16 have a cross-section which is shown in FIG. 5 on an enlarged scale. It will be obvious that the conductors in this embodiment show two grooves which are directed towards the sides 18 of the pinch seal. Said grooves are denoted by 19. Due to said direction of the grooves, the quartz glass denoted by 20 will not flow into the grooves during the formation of the pinch seal but will form cavities 21 and 22 into which the melting foil material can escape.

In the embodiment shown, each time one conductor is welded to each side of the foils. Of course, the invention may also suitably be used in constructions in which two leadthrough conductors are secured to each foil.

The lamps shown in the Figure are constructed as halogen incandescent lamps destined for operation at a voltage of 220 volts. It is just in these lamps, which are suitable for example, for projection purposes, that the phenomenon of the explosion of the lamp envelope plays an important role.

What is claimed is:

1. An electric incandescent lamp which comprises a lamp envelope of a transparent material, in which a filament is stretched, which lamp envelope is sealed by at least one pinch seal in which at least one thin foil is sealed, which foil is welded to two or more conductors extending outside the pinch seal, characterized in in that the pinch seal comprises means which form a cavity which adjoins the point of the weld of the foil to at least one of the conductors, wherein said means is formed by a sheath-like member which surrounds the conductor and the inner diameter of which is at least 100 microns larger than the diameter of the conductor.

2. An electric incandescent lamp as claimed in claim 1, characterized in that the sheath-like member is formed by a helically wound piece of wire which surrounds the conductor in radially spaced relation thereto.

3. An electric incandescent lamp as claimed in claim 1, characterized in that the sheath-like member is formed by a tube of quartz glass which surrounds the conductor in radially spaced relation thereto.

* * * * *